US006578875B2

(12) United States Patent
Tamura et al.

(10) Patent No.: US 6,578,875 B2
(45) Date of Patent: Jun. 17, 2003

(54) PRODUCT LABEL

(75) Inventors: Toshiyuki Tamura, Mishima (JP); Takayuki Hiyoshi, Suntoh-gun (JP); Yukihiro Takada, Tagata-gun (JP); Yoshiaki Shibata, Yokohama (JP); Yuichiro Hatanaka, Tagata-gun (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/987,263

(22) Filed: Nov. 14, 2001

(65) Prior Publication Data

US 2002/0056991 A1 May 16, 2002

(30) Foreign Application Priority Data

Nov. 14, 2000 (JP) ..... 2000-346397

(51) Int. Cl.[7] ..... B42D 15/00

(52) U.S. Cl. ..... 283/114; 283/81; 283/95; 428/913

(58) Field of Search ..... 283/72, 79, 80, 283/81, 114, 101, 105, 95; 428/913

(56) References Cited

U.S. PATENT DOCUMENTS

| | | | | |
|---|---|---|---|---|
| 3,892,569 A | | 7/1975 | Speers | |
| 4,590,497 A | * | 5/1986 | Shibata et al. | 428/913 |
| 5,550,097 A | | 8/1996 | Shibasaki et al. | |

FOREIGN PATENT DOCUMENTS

| | | |
|---|---|---|
| JP | 2-84379 | 3/1990 |
| JP | 2000-190541 | 7/2000 |

* cited by examiner

*Primary Examiner*—Willmon Fridie, Jr.
(74) *Attorney, Agent, or Firm*—Oblon, Spivak, McClelland, Maier & Neustadt, P.C.

(57) ABSTRACT

A product label in which a heat sensitive recording layer and a heat sensitive color forming layer for printing goods information are laminated on a substrate, the heat sensitive recording layer and the heat sensitive color forming layer form colors different from each other and the heat sensitive color forming layer forming an emphasis area. Partial disposition of the heat sensitive color forming layer for the emphasis area can provide a product label of inexpansive material cost and capable of heat sensitive recording for two or more colors with no color mixing under simple control.

7 Claims, 2 Drawing Sheets

PRODUCT LABEL

CROSS REFERENCE TO RELATED APPLICATIONS

The present application is based on Japanese Priority Documents 2000-346397 filed on Nov. 14, 2000 the content of which is incorporated herein by reference.

BACKGROUND OF THE INVENTION

1. Field of the Invention

The present invention relates to a product label and, more in particular, it relates to a sales promotion label, for example, a product label used on foodstuffs such as meat and fish which are displayed on selling stores.

2. Discussion of the Background

Generally, a product label which is used for the sale of foodstuffs and appended on goods comprises a sales promotion indication area for indicating the sales promoting information and a goods content indication area for explaining the content of the goods. Letters such as for special price, illustrations or POP advertisement are printed in the promotion indication area and name of goods, data for measured weight, usual price, production date, bar code, etc. are printed in the goods content indication area.

For example, Japanese Published Unexamined Patent Application 2000-98897 specifically discloses a product label comprising a sales promotion indication area and a goods content indication area in which the content of the sales promotion indication area is printed in a color different from that for the goods content indication area. Japanese Published Unexamined Patent Application Hei 11-7243 discloses a label of printing an emphasis area (emphasized indication area) and a non-emphasis area (goods content indication area) by different colors selectively using heat sensitive paper that forms two kinds of colors depending on the level of the heating temperature. Message such as information for special price and service goods of the month, illustration and the like are printed in the emphasized indication area. Japanese Published Unexamined Patent Application Hei 10-337911 describes a method for attaining two color printing by the combination of heat sensitive paper and thermal transfer system, as well as a method of printing by plural printing means such as ink jet printing.

In the product label, method of using two color heat sensitive paper, a thermal color transfer printing system or plural printing systems has been proposed by disposing an emphasis area for the sales promotion of goods and an information region as a non-emphasis area and make the color of emphasized letters and figures such as POP or special price information different from the color of the information region in order to appeal the goods more effectively. However, two color heat sensitive paper requires to provide high and low levels of heat energy for each of heat sensitive layers, which complicates the control and requires high temperature heating. Therefore, it is may be considered that the printing speed is restricted, working life of the thermal head is deteriorated and the color mixing is caused inevitably since a lower temperature area is present at the periphery of high temperature heating. Further, the thermal transfer system required plural transfer ribbons and thermal heads for providing plural colors and was, therefore, expensive. Further, the method of using the ink jet and the thermal transfer system in combination with the heat sensitive paper increased the cost of the apparatus since plural printing systems were required.

SUMMARY OF THE INVENTION

In view of the above, the present invention intends to provide a product label which can reduce the material cost for the label and enables heat sensitive recording of two or more colors with no color mixing under simple control.

The present invention also intends to provide a product label which can be printed by the application of an identical amount of heat energy upon heat sensitive recording for two or more colors, not requiring special heat control and enabling high speed printing.

These objects of the present invention are achieved by the novel product label of the present invention.

According to the novel product label of the present invention, a heat sensitive recording layer and a heat sensitive color forming layer for printing goods information are laminated on a substrate. The heat sensitive color forming layer forms a color different from that of the heat sensitive recording layer, to form an emphasis area. The heat sensitive color forming layer for the emphasis area is disposed partially.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
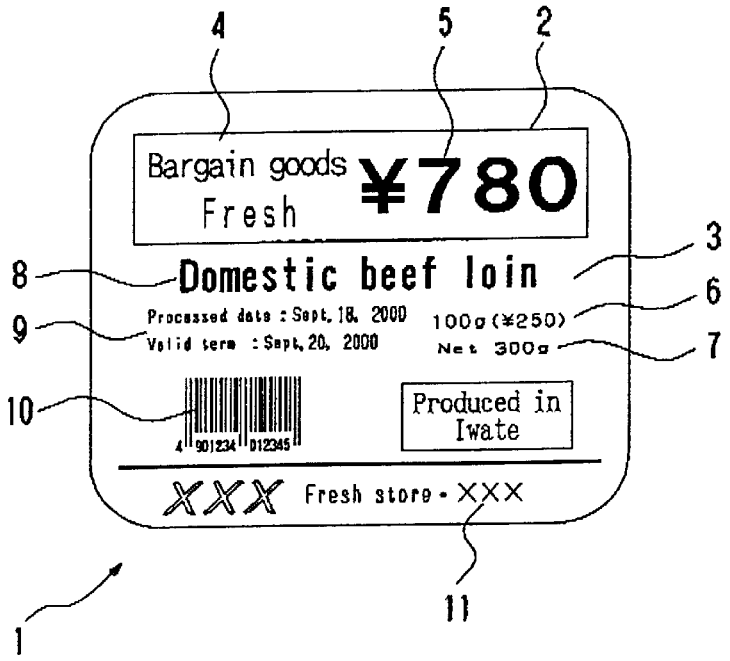
FIG. 1(A) is a plan view illustrating a product label in a first embodiment according to the present invention.

According to the present invention, a multi-color label capable of forming at least two colors is used for a product label in which a heat sensitive color forming layer for printing goods information to be indicated in an emphasis area and a heat sensitive recording layer for printing goods information to be indicated in other information area form colors different from each other, wherein the heat sensitive color forming layer for the emphasis area is disposed partially. Accordingly, since the heat sensitive color forming layer for the emphasis area is formed partially, required heat sensitive recording for two or more colors is enabled in a label structure capable of saving the material cost and, as a result, the emphasis area and the goods content indication area can be provided simply.

The product label of the present invention may be called other name like package label, consumer package label or the like. The name of the product label, generally, depends on the goods to which the product label will be attached.

In the present invention, the heat sensitive color forming layer may be laminated on a desensitizing region in which a portion of the heat sensitive recording layer is partially decreased or inactivated in view of the heat sensitive color forming function. As such material, a heat sensitive layer represented by heat sensitive recording paper coated with an electron accepting compound and an electron donating compound, a sensitizer and a lubricant, a coloration inhibitor and a coloration stabilizer by the aid of a binder resin can be used for the heat sensitive recording layer. Further, a desensitizing region formed by decreasing or inactivating the sensitivity, for example, with an organic amine material is formed to a portion of the heat sensitive recording layer and a heat sensitive color forming layer that forms a color different from that of the heat sensitive recording layer is laminated on the desensitizing region. The same material can be used for the beat sensitive color forming layer as that for the heat sensitive recording layer. Accordingly, since the desensitizing region is disposed to a portion on the heat sensitive recording layer and the heat sensitive color forming layer is laminated on the desensitizing region, heat sensitive recording for two or more colors can be conducted under simple control with no color mixing and, as a result, the emphasis area and the goods content indication area can be provided simply.

A barrier layer may be disposed between the desensitizing region and the heat sensitive color forming layer. There is no particular restriction for the material of the barrier layer so long as the desensitizer such as an organic amine material used for the desensitizing region can be prevented from intruding into the heat sensitive color forming layer and gives no undesired effect on the heat sensitive color forming layer upon heating, has no concern with the heat sensitive recording layer and undergoes no change in itself. For example, a UV-acrylic resin or the like may be used. Accordingly, since the barrier layer is disposed between the desensitizing region and the heat sensitive color forming layer, a favorable color forming layer can be obtained in which the sensitizer is not diffused into the heat sensitive color forming layer and the concentration is not lowered.

Further, the heat sensitive recording layer and the heat sensitive color forming layer may also be adapted to form colors by the application of an identical amount of heat energy. Accordingly, since the color forming printing can be conducted both in the emphasis area and the goods content indication area each with a high sensitivity and with an application of an identical amount of heat energy, printing is possible with no requirement for special heat control, at high speed and without deteriorating the life of the thermal head. In addition, since printing can be conducted by the same procedures as those for usual heat sensitive paper, plural printing units or special device are no more required and the cost of the label issuing apparatus can be decreased.

Figure 1B:
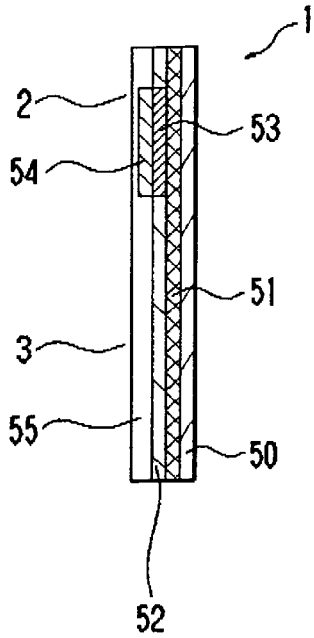
FIG. 1(B) is a longitudinal side elevational cross sectional view of a product label shown in FIG. 1(A), with the thickness being exaggerated.

A first embodiment of the present invention is now explained with reference to FIG. 1. FIG. 1 shows a product label in a first embodiment of the present invention, in which FIG. 1(A) is a plan view thereof and FIG. 1(B) is a longitudinal side elevational cross sectional view thereof with the thickness view exaggerated.

The product label comprises an emphasized indication area (emphasis area) 2 and a goods content indication area 3. In the goods content indication area 3, information for the administration of goods, and unit price 6 per 100 g, net weight indication 7, name of goods 8, processing date-and-validity term for use 9, bar code 10 and production place information 12 are printed. Further, the name of the store (such as a super market) 11 has already been printed (which may be printed upon label issuing). Further, the emphasized indication area 2 is printed with an emphasized information (POP information 4, special price 5) intended to be emphasized for the goods. For example, the special price 5 or, depending on the case, information for direct delivery from the place of production or special place of production may also be printed. Further, the product label 1 of this embodiment is adapted to form colors which are different between the emphasized indication area 2 and the goods content indication area 3.

The cross sectional structure of the label for this constitution is to be explained with reference to FIG. 1(B). In the product label 1 according to this embodiment, an undercoat layer 51 and a heat sensitive recording layer 52 are laminated on a substrate 50. The heat sensitive recording layer 52 forms a black color by the application of the heat energy. A portion of the heat sensitive recording layer 52 is formed as a desensitizing region 53 which is decreased or inactivated for the color forming function. That is, the desensitizing region 53 is in a state of scarcely forming color even when applied with heat energy. Further, the heat sensitive color forming layer 54 that forms a color different from that of the heat sensitive recording layer 52 is laminated on the desensitizing region 53 and, optionally, a protection layer 55 is further laminated. That is, a portion consisting only of the heat sensitive recording layer 52 is used for the black printing of the goods content indication area 3, while a laminated portion of the heat sensitive color forming layer 54 on the desensitizing region 53 is used for the emphasized indication area 2 and adapted to form printing color different from that of the heat sensitive recording layer 52.

Referring more specifically, an undercoat layer 51 comprising clay and binder resin was coated by 8 $\mu$m on a substrate 50 followed by calendering. The undercoat layer 51 was coated by a die coating method.

Heat Sensitive Recording Layer 52

Liquid Developer Dispersion

Developer: 4-hydroxy-4'-isopropoxydiphenyl sulfone liquid dispersion (F-647, manufactured by Chukyo Oils and Fats Co.)

17.5 parts by weight

Sensitizer: methylsteroamide liquid dispersion (D-757, manufactured by Chukyo Oils and Fats Co.)

16 parts by weight

Lubricant: zinc stearate liquid dispersion (Z-7-30, manufactured by Chukyo Oils and Fats Co.)

4 parts by weight

Coloration inhibitor: paraffin wax liquid dispersion (D-337, manufactured by Chukyo Oils and Fats Co.)

1.75 parts by weight

Inorganic pigment: aluminum hydroxide 1 part by weight

FVA 117 (10% solution)

2.5 parts by weight

The blend was dispersed for three hours by a paint shaker to obtain a liquid dispersion.

Leuco Liquid

Liquid dispersion of leuco dye ODB-2 (H-272, manufactured by Chukyo Oils and Fats Co.)

5 parts by weight

The leuco dye and the liquid developer dispersion were mixed, and coated by a die coating method so as to provide 5 g/m$^2$ of dry weight to obtain a heat sensitive recording layer 52.

Preparation of Desensitizing Region 53

1 part by weight of 2-methyl piperazine was dissolved as a desensitizer to 4 parts by weight of a solution formed by diluting IB-F370 (manufactured by Sanyo Kasei Co.) to 15% solution with a 1:1 solution of IPA and propylene glycol monomethyl ether and the solution was coated and dried by flexographic printing to a coating amount of 8 g/m$^2$ to obtain a partial desensitizing region 53.

Heat Sensitive Color Forming Layer 54

The heat sensitive color forming layer 54 is adapted to form color other than black in the heat sensitive recording layer 52, for example, to form a red color.

Liquid Developer Dispersion

Developer: 4-hydroxy-4'-isopropoxydiphenyl sulfone liquid dispersion (F-647, manufactured by Chukyo Oils and Fats Co.)

17.5 parts by weight

Sensitizer: methylsteroamide liquid dispersion (D-757, manufactured by Chukyo Oils and Fats Co.)

16 parts by weight

Lubricant: zinc stearate liquid dispersion (Z-7-30, manufactured by Chukyo Oils and Fats Co.)

4 parts by weight

Coloration inhibitor: paraffin wax liquid dispersion (D-337, manufactured by Chukyo Oils and Fats Co.)

1.75 parts by weight

Inorganic pigment: aluminum hydroxide 1 part by weight

PVA 117 (10% solution)

2.5 parts by weight

The blend was dispersed for three hours by a paint shaker to obtain a liquid dispersion.

Leuco Liquid 5 parts by weight of liquid dispersion of PSD-Em was used for the leuco liquid (H-683, manufactured by Chukyo Oils and Fats Co.) and mixed with the liquid developer and laminated by flexographic printing to the desensitizing region 53 to obtain a dry film thickness of 4 $\mu$m.

Formation of Protection Layer 55

For the protection layer 55, a liquid dispersion obtained by dispersing 1 part by weight of aluminum hydroxide to 10 parts by weight of a 10% solution of PVA 117 in a paint shaker with glass beads was laminated to a dry film thickness of 2 $\mu$m.

Further, calendering was applied to complete the label. Actually, the product label 1 is disposed at the rearface thereof with releasable paper and adhesive and half cut into a required size to be completed.

In the thus obtained product label 1, since the heat sensitive color forming layer 52 is laminated on the desensitizing region 53 relative to the goods content indication area 3 that forms a black color by the heat sensitive recording layer 52, there is no color mixing at all and each of the heat sensitive recording layer 52 and the heat sensitive color forming layer 54 can form color and conduct printing at each color by the application of an identical quantity of heat energy and no complicate heat control is required.

In this embodiment, the desensitizing region 53 is formed to the heat sensitive recording layer 52 but the heat sensitive color forming layer 54 for the emphasis area 2 may be disposed on the undercoat layer 51 to partially form the desensitizing region 53 and the heat sensitive recording layer 52 that forms a black color may be laminated partially. Further, while the red leuco dye was used for the heat sensitive color forming layer 54, BLUE 63 (manufactured by Yamamoto Kasei Co.) or crystal violet lacton (CVL) may be used, for example, as the blue leuco dye. Further, other green and yellow leuco dyes may also be used. In addition, the developer and the sensitizer are not restricted to those described above and any of agents may be used so long as having the function of forming color by coupling with the leuco dye by heat energy and capable of forming the desensitizing region 53 to the heat sensitive recording layer before lamination of the heat sensitive color forming layer 54.

In the same manner when the desensitizing region 53 is formed, 20 parts by weight of cis-2,6-dimethylpiperazine were dissolved to 80 parts by weight of a solution in which the resin ingredient, for example, of SANPREN IB-F370 (resin ingredient 40%, manufactured by Sanyo Kasei Co.) was diluted to 15%, to prepare a desensitizing liquid having a function of inactivating or decreasing the color forming function of the heat sensitive recording layer 52. The desensitizing liquid is coated on the heat sensitive recording layer 52 at a predetermined desensitizing region 53 by flexographic printing to a coating amount of 8 g/m$^2$, dried in a circumstance at 60° C. to partially form the desensitizing region 53 to a portion of the heat sensitive recording layer 52.

In the example shown in FIG. 1(B), the heat sensitive color forming layer 54 is formed by printing on the desensitizing region 53 with an identical size. However, it may suffice that at least a portion for forming the color to the emphasis area 2 constitutes the desensitizing region 53 and, for example, the heat sensitive color forming layer 54 may be formed in a region narrower than the desensitizing region 53, or, vice versa, it may suffice that the desensitizing region 53 is formed at least for the portion applied with the heat energy as the emphasis area 2.

Figure 2:
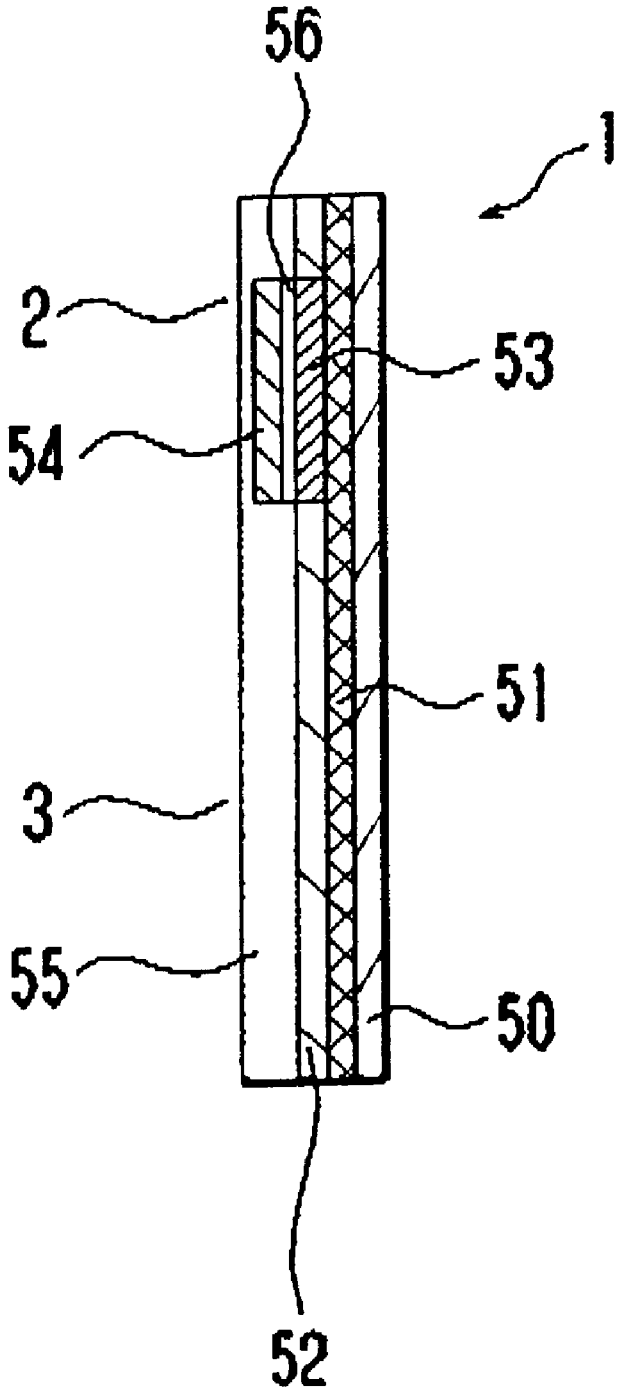
FIG. 2 is a longitudinal side elevational cross sectional view of a product label in a second embodiment according to the present invention with the thickness being exaggerated.

A second embodiment of the present invention is to be explained with reference to FIG. 2. The same parts as those in the first embodiment are designated by the same reference numerals, and are not again explained herein.

The product label 1 of this embodiment is basically identical with the first embodiment in view of the method of use and the function, excepting that a barrier layer 56 is disposed between the desensitizing region 53 and the heat sensitive color forming layer 54 in this embodiment. When a heat sensitive color forming layer 54 is formed directly on the desensitizing region 53, the color forming density of the heat sensitive color forming layer 54 may sometimes be lowered depending on the thermal diffusion of the desensitizer in the desensitizing region 53 and the humidity. In view of the above, the barrier layer 54 is interposed for overcoming the problem in this embodiment.

The process up to the formation of the desensitizing region 53 is identical with that of the first embodiment. A barrier layer 56 is coated by using a 15% solution of SCX-70 (manufactured by Johnson Polymer Co.) (SCX-70: 3 parts by weight, water: 2 parts by weight, IPA: 1 part by weight) to the desensitizing region 53 by flexographic printing to a dry film thickness of 2 $\mu$m. Further, the heat sensitive color forming layer 54 described above is formed on the barrier layer 56 and the protection layer 55 is disposed to complete the product label 1.

According to this embodiment, since the barrier layer 56 is disposed between the desensitizing region 53 and the heat sensitive color forming layer 54, the desensitizer does not diffuse to the heat sensitive color forming layer 54 and a favorable color forming layer with no lowering of the density can be obtained.

Further, since the heat sensitive recording layer 52 and the heat sensitive color forming layer 54 can form color by the application of an identical amount of heat energy and the sensitivity can be increased for both of the layers in the same manner as in the first embodiment, a product label 1 with no complicate thermal hysteresis control, printable at a high speed and with no color mixing at all can be obtained. Further, since the product label 1 can be printed without changing the energy of the printing between the regions for the emphasis area 2 and the goods content indication area 3, load on the label issuing apparatus can be decreased. Further, since the sensitivity of the heat sensitive recording layer 52 and the heat sensitive color forming layer 54 can be increased, the working life of the thermal head is not worsened.

While the embodiments have been explained with reference to the examples of two color printing, a partially multi-colored product label with no color mixing at all can of course be obtained by forming the desensitizing region 53 to a portion of the heat sensitive recording layer 52, optionally forming the barrier layer 56 on the desensitizing region 53 and then disposing multi-color heat sensitive color forming layers 54 each of different color on the desensitizing region 53.

Further, descriptions have been made to a case of disposing the heat sensitive recording layer 52 on the substrate 50. Alternatively, commercially available heat sensitive paper having a color forming layer may be used in which a desensitizing region 53 is formed by partially inactivating or decreasing the function of the color forming layer as the heat sensitive recording layer 52 and, optionally, a barrier layer 56 may be disposed and then the heat sensitive color forming layer 54 may be disposed.

Obviously, numerous modifications and variations of the present invention are possible in light of the above teachings. It is therefore to be understood that within the scope of the appended claims, the invention may be practiced otherwise than as specifically described herein.

What is claim is:

1. A product label comprising:

a substrate;

a heat sensitive recording layer laminated on the substrate for printing goods information;

a desensitizing region partially provided on the heat sensitive recording layer which is decreased or inactivated for a color forming function so that the desensitizing region is in a state of scarcely forming a color even when applied with heat energy; and a heat sensitive color forming layer laminated on the desensitizing region of the substrate for forming a color different from that of the heat sensitive recording layer to form an emphasis area and printing goods information to be indicated in the emphasis area.

2. A product label according to claim 1, wherein a barrier layer is disposed between the desensitizing region and the heat sensitive color forming layer.

3. A product label according to claim 1, wherein each of the heat sensitive recording layer and the heat sensitive color forming layer can form a color by the application of an identical amount of heat energy.

4. A label comprising:

a substrate;

a heat sensitive-recording layer provided on the substrate;

a desensitizing region partially provided on the heat sensitive recording layer which is decreased or inactivated for a color forming function so that the desensitizing region is in a state of scarcely forming a color even when applied with heat energy; and a heat sensitive color forming layer provided on the desensitizing region of the substrate for forming a color different from that of the heat sensitive recording layer.

5. A label according to claim 4, wherein a barrier layer is disposed between the desensitizing region and the heat sensitive color forming layer.

6. A label according to claim 4, wherein each of the heat sensitive recording layer and the heat sensitive color forming layer can form a color by the application of an identical amount of heat energy.

7. A label according to claim 5, wherein each of the heat sensitive recording layer and the heat sensitive color forming layer can form a color by the application of an identical amount of heat energy.

* * * * *